US005202086A

United States Patent [19]

Baliga et al.

[11] Patent Number: 5,202,086

[45] Date of Patent: Apr. 13, 1993

[54] ARAMID FABRIC FOR GARMENTS OF IMPROVED COMFORT

[75] Inventors: Bantwal J. Baliga, Chesterfield, Va.; Donald E. Hoffman, Newark, Del.

[73] Assignee: E. I. Du Pont de Nemours and Company, Wilmingon, Del.

[21] Appl. No.: 899,281

[22] Filed: Jun. 16, 1992

[51] Int. Cl.[5] ..... D03D 3/00

[52] U.S. Cl. ..... 428/225; 2/243 A; 139/420 A; 428/902; 428/911

[58] Field of Search ..... 428/225, 902, 911; 2/243 A; 139/420 A

[56] References Cited

U.S. PATENT DOCUMENTS

| | | | |
|---|---|---|---|
| 4,120,914 | 10/1978 | Behnke et al. | 260/857 TW |
| 4,198,494 | 4/1980 | Burckel | 525/432 |
| 4,792,480 | 12/1988 | Freund et al. | 428/296 |
| 4,897,296 | 1/1990 | Marshall | 428/296 |
| 5,082,721 | 1/1992 | Smith et al. | 428/296 |

*Primary Examiner*—James J. Bell

[57] ABSTRACT

A woven fabric of yarns spun from poly(m-phenylene isophthalamide) staple fiber has been designed to provide protective garments of improved comfort.

3 Claims, No Drawings

ARAMID FABRIC FOR GARMENTS OF IMPROVED COMFORT

BACKGROUND OF THE INVENTION

A common problem with most protective apparel is lack of comfort. One is reluctant to wear a garment that is heavy, bulky, stiff, rough or that has poor moisture transfer and yet unless the garment is worn, it cannot provide protection. The present invention is directed to a woven fabric consisting essentially of poly(m-phenylene isophthalamide) fiber for use in protective garments of improved comfort.

SUMMARY OF THE INVENTION

This invention provides a woven fabric for use in protective apparel of improved comfort consisting essentially of uncrystallized poly(m-phenylene isophthalamide) staple fiber having a denier per filament (dpf) of from 0.8 to 1.5, said fabric having a basis weight of from 4.0 to 8 ounces per square yard (oz/yd$^2$) and a construction as follows:

| | |
|---|---|
| weave: | plain or twill |
| cotton count (cc): | 37/2 or finer |
| warp count (ends/inch): | 75 to 125 |
| fill count (ends/inch): | at least 40 but not greater than 80% of the warp count. |

The fabrics of the invention have a bending rigidity per centimeter (B) no greater than 0.09 gram force (gf) cm$^2$/cm, a shear stiffness (G) no greater than 0.8 gf/cm deg., a surface roughness (SMD) no greater than 8.0 micrometers and a peak in transient heat loss, (Qmax), of at least 12 watts/meter$^2$ • C.(W/M$^2$ • C.), all measured as described below.

DETAILED DESCRIPTION OF THE INVENTION

It is well known in the art that certain fabric characteristics translate into comfort levels that can be expected when such fabrics are made into apparel. The challenge is to attain these characteristics in high basis weight fabrics from fibers which are employed in protective apparel. The fabrics under consideration have a basis weight of from 4.0 oz/yd$^2$ to 8 oz/yd$^2$ and are woven from yarns consisting essentially of poly(m-phenylene isophthalamide) MPD-I, staple fiber. If desired, up to 10 weight percent of such fiber may be replaced with other fiber such as p-aramid fiber, antistatic fiber, etc., which provide break open resistance, antistatic performance, etc., providing the value of the fabric for the protective end-use is not unduly compromised.

The MPD-I staple fiber employed has a denier of from 0.8 to 1.5 dpf and the spun yarns are 37/2 cc or finer. Moreover, the fiber should not be subjected to treatments which tend to crystallize the fiber since this will increase the bending rigidity. By "uncrystallized" is meant that no active steps were taken to impart crystallinity, however, this is not to say that the fiber has no crystallinity Woven fabrics of the invention are of unbalanced construction, more particularly, the fill (F) count should be no greater than 80% of the warp count. The weave may be plain or will preferably be a 3×1 twill. The warp (W) count can range from 75 to 125 ends/inch while the fill count should be at least 40 ends/inch.

The fabrics of the invention are characterized by relatively low bending rigidity, shear stiffness and surface roughness while providing good wicking and thermal conductance.

Test and Measurements

The fabric hand properties were measured using the Kawabata Evaluation System (KES). KES is a method of measuring mechanical and surface properties of fabrics using a set of very sensitive instruments described in Kawabata, S., "The Standardization and Analysis of Hand Evaluation", The Textile Machinery Society of Japan, July, 1980, 2nd Ed., Osaka, Japan and manufactured by Kato Tekko Co., Kyoto, Japan. The thermal parameter Qmax is related to the human cutaneous sensation of warm/cool feeling when coming in contact with a flat surface. The principles and experimental procedures for Qmax determination using a "Thermolabo" are described in detail in the Journal of the Textile Machinery Society of Japan, 37, T130 (1984) Kawabata, S., and "Application of the New Thermal Tester 'Thermolabo' to the Evaluation of Clothing Comfort" eds. S. Kawabata, R. Postle and M. Niwa, The Textile Machinery Society of Japan, 1985. KESFB series of instruments were used for this work. A description of test methods is given below. All of these tests can be run on a single 20 cm ×20 cm sample. The bending and shear stiffness properties were measured on washed fabarics to remove any effect of water soluble stiffness builders that are generally added to facilitate cutting and sewing. The fabrics were washed and dried using AATCC method 135. All other properties were measured on finished fabrics before washing.

Bending Tester

In this instrument, a specimen sample is mounted between two chucks (one stationary and one movable) that are 1 cm apart. The specimen is subjected to pure bending between the curvatures K=−2.5 and 2.5 (cm$^{-1}$) with constant rate of curvatures change. The rate is 0.50 (cm$^{-1}$)/sec. The fixed end of the specimen is on a rod which is also supported by piano wires at both ends. The bending moment induced by the bending deformation is picked up by this torque meter arrangement and curvature is detected by measuring the rotation angle of the crank. Through a system of electrical signal circuits, the bending moment and curvature are sent to a x-y recorder and plotted. The slope of the curve of bending moment vs. curvature is bending rigidity (B) and is represented by the following equation:

$$M=BxK+HB$$

where M is bending moment per unit width of fabric (gf x cm/cm)

K is curvature (cm$^{-1}$)

B is bending rigidity per unit width (gf×cm$^2$/cm)

HB is intercept when K=0 and is also a measure of hysteresis. The bending stiffness B reported is the mean of two slopes. One of them, Bf is the slope of the M-K curve when the fabric is bent with its surface on the outside. The other is the gradient Bg of the similar straight line when the fabric is bent with its back surface to the outside. Thus, B=(Bf +Bg)/2. For woven fabrics, bending stiffness B is measured for both warp and fill directions by the above procedures and the average of warp and fill direction is reported.

Shear Tester

The same instrument is used for both shear and tensile testing in the KES system. The specimen is clamped by two chucks (A and B) 20 cm long and 5 cms apart. One of the chucks (B) is mounted on a sliding base which can be moved backwards for tensile testing and sideways for shear testing. The other chuck is fixed to a 4 cm diameter drum connected to a torque detector for the shear measurement. A constant tension (10 gf/cm) applied to the fabric by a weight mounted on the drum. This drum is fixed via a chuck for tensile testing but can be freed to rotate. The shear force is detected by a transducer connected with chuck B along the shear direction. After a constant tensile force is applied to the fabric, chuck B moves perpendicular to the direction of the tensile stress by a synchronous motor at a constant rate. The shear strain is detected by a potentiometer. When chuck B slides 8 degrees of shear angle, the motor automatically reverses. The velocity of shearing is 0.417 mm/sec and the shear strain rate is 0.00834/sec. The shear force vs. shear angle curve is plotted on a x-y plotter. Shear stiffness G is the slope of this curve. G is defined as (shear force per unit length)/shear angle). Its units are gf/cm degree. The slope is measured between shearing angles 0.5° and 5.0°

Surface Tester

The KES surface tester was used to measure surface roughness. The probe for measurement of surface roughness is made from a steel piano wire of 0.5 mm diameter bent to a U-shape.

The 20 cm×20 cm fabric is clasped to a winding drum by a chuck and the other end is clamped to the end of a weighted arm hinged at one end. The weighted arm allows the maintenance of a fixed tension in the fabric when the measurements are made. For the surface roughness measurement, the piano wire probe box is lowered onto the sample and the spring tension adjusted for 10 g normal force. The sample is moved 3 cm by the rotation of the drum by a synchronous motor in one direction at the rate of 1 mm/sec and then the motor is reversed at the same rate to return to the starting position. The vertical movement of the probe caused by the roughness of the sample surface are detected by the transducer and integrated. Of the 3 cm of fabric movement, 0.5 cm at each end is not included in the analysis to avoid signals in the transition status. This is done by providing input voltage to the integrator only between the first and last 0.5 cm of fabric movement in each direction.

The vertical displacement of the contactor from a standard position of Z(cm), is recorded and the surface roughness (SMD) is represented by the mean deviation from Z.

$$SMD = \frac{1}{L_{max}} \int_0^{L_{max}} (Z - Z)dL$$

where Lmax represents the sweep length.

Thermolabo Tester for Qmax

The Thermolabo instrument consists of three main elements; T-Box, BT-Box and Water-Box. T-Box consists of a thin copper plate of 3 cm×3 cm attached to a block of insulating material. The change in temperature of the copper plate is measured by a temperature sensor of high response speed attached to the back side of the copper plate. The BT-Box is an insulated hot plate capable of being controlled from room temperature to up to 60° C. The Water-Box is a constant temperature plate through which water at a constant temperature flows. This is considered a heat capacitor having infinite capacity. Styrofoam plates are used instead of the Water-Box during "Qmax" test on thin fabrics and when room temperature and humidity are controlled.

Qmax Measurement

The room temperature is first sensed by placing the "T-Box" with the copper plate facing upwards. The BT-Box is then set to a temperature of 10° C. higher than the T-Box. The guard heater on the BT-Box is also set to the same temperature. When the temperature of the BT-Box and BT guard reach the set temperature, the T-Box is placed face down on the BT-Box until its temperature reaches the BT-Box temperature. The fabric sample is then placed on the Styrofoam plates or the water box. When room temperature is controlled, Styrofoam plates can be used. If the room temperature is not controlled, the water box at a controlled temperature should be used. For Qmax measurement, the T-Box is removed from the BT-Box and immediately placed on the room temperature equilibrated sample. The peak in transient heat loss from T-Box to the fabric is Qmax and is measured from the temperature of the T-Box which is converted to Qmax by analog circuits as shown below:

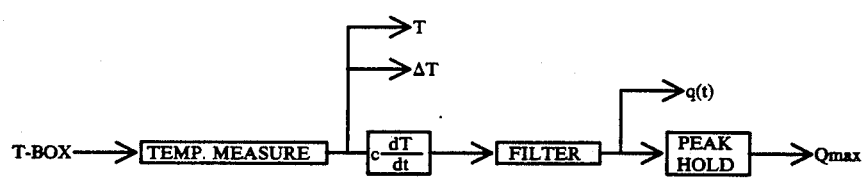

The Qmax measurement takes very little time with the peak reached typically in ~0.2 sec. after initiation of the test.

The following examples are illustrative of the invention (except for controls) and are not to be construed as limiting.

EXAMPLES

In each of the following examples found in Table 1, spun yarn of MPD-I staple fiber (uncrystallized) was woven into a fabric which were dyed. The yarns were two ply yarns. Fiber dpf and yarn size are listed in the Table along with type of weave, warp and fill count and fabric basis weight. The comfort characteristics of each of the resulting fabrics are given. It will be noted that control fabrics A, B and C have undesirable roughness and poor Qmax while fabric C is also deficient in the G value.

TABLE 1

| | Control A | Control B | Control C | Ex. 1 | Ex. 2 | Ex. 3 |
|---|---|---|---|---|---|---|
| DPF | 1.7 | 1.7 | 1.7 | 1.3 | 1.3 | 1.0 |
| Yarn Size, cc | 26/2 | 33/2 | 28/2 | 39/2 | 39/2 | 39/2 |
| Weave | Plain | Plain | Plain | Plain | 3X1 | 3X1 |
| WXF Count End/In | 44 × 44 | 68 × 48 | 56 × 56 | 84 × 45 | 115 × 52 | 110 × 72 |
| Fabric Wt. oz/yd$^2$ | 4.9 | 5.4 | 6.0 | 5.1 | 6.9 | 7.1 |
| Qmax, W/M$^2$ °C. | 10.0 | 10.9 | 10.5 | 14.0 | 13.5 | 14.0 |
| SMD, Micrometer | 12.9 | 8.3 | 8.7 | 5.7 | 7.7 | 4.2 |
| B, Gf-cm$^2$/cm | 0.07 | 0.08 | 0.09 | 0.06 | 0.08 | 0.08 |
| G, Gf/cm Deg | 0.5 | 0.5 | 1.7 | 0.3 | 0.4 | 0.7 |

No control has been presented to illustrate the adverse effect of using crystalline fiber in preparing the fabrics. However, tests have been performed which show that the surface roughness, bending rigidity and shear force values of such fabrics will not measure up to the comfort standards of the present invention.

We claim:

1. A woven fabric for use in protective apparel of improved comfort consisting essentially of spun yarns of uncrystallized poly(m-phenylene isophthalamide) staple fiber having a 0.8 to 1.5 denier per filament; said fabric having a basis weight of from 4.0 to 8 ounces per square yard and a construction as follows:

| | |
|---|---|
| weave: | plain or twill |
| Yarn: | 37/2 or finer |
| warp count: | 75 to 125 ends/inch |
| fill count: | at least 40 end/inch but not greater than 80% of the warp count. |

2. A woven fabric according to claim 1 wherein the fabric weave is a 3X1 twill fabric.

3. Protective garment of improved comfort constructed from the woven fabric of claim 1.

* * * * *